US011013944B2

(12) United States Patent
Swanson

(10) Patent No.: US 11,013,944 B2
(45) **Date of Patent: *May 25, 2021**

(54) FOLDABLE DIVING PLATFORM FOR WAKEBOARD TOWER

(71) Applicant: Curt Scott Swanson, Bend, OR (US)

(72) Inventor: Curt Scott Swanson, Bend, OR (US)

( * ) Notice: Subject to any disclaimer, the term of this patent is extended or adjusted under 35 U.S.C. 154(b) by 84 days.

This patent is subject to a terminal disclaimer.

(21) Appl. No.: 16/661,545

(22) Filed: Oct. 23, 2019

(65) Prior Publication Data

US 2020/0054912 A1 Feb. 20, 2020

Related U.S. Application Data

(63) Continuation of application No. 15/906,900, filed on Feb. 27, 2018, now Pat. No. 10,478,653.

(51) Int. Cl.

| | |
|---|---|
| ***A63B 5/10*** | (2006.01) |
| ***B63B 17/00*** | (2006.01) |
| ***A63B 5/08*** | (2006.01) |

(52) U.S. Cl.

CPC ..... *A63B 5/10* (2013.01); *B63B 17/00* (2013.01); *A63B 2005/085* (2013.01); *A63B 2210/50* (2013.01); *A63B 2244/22* (2013.01)

(58) Field of Classification Search

CPC ... A63B 5/10; A63B 2244/22; A63B 2210/50; A63B 2005/085; A63B 5/00; A63B 5/08; A63B 5/11; A63B 2005/08; B63B 17/00; B63B 34/67; B63B 34/00

USPC ..... 114/364

See application file for complete search history.

(56) References Cited

U.S. PATENT DOCUMENTS

| | | | |
|---|---|---|---|
| 2,461,086 | A | 2/1949 | Schumacher |
| 2,805,859 | A | 9/1957 | Rude |
| 3,371,928 | A | 3/1968 | Buddo |
| 3,408,069 | A | 10/1968 | Lewis |
| 3,517,929 | A | 6/1970 | Sampson, Jr. |
| 3,767,193 | A | 10/1973 | Johnson |
| 4,045,021 | A | 8/1977 | Nissen |
| 4,423,698 | A | 1/1984 | Peluso |
| 4,971,315 | A | 11/1990 | Rector |
| 2004/0144295 | A1 | 7/2004 | Bierbower, Jr. |
| 2011/0278335 | A1 | 11/2011 | Jesewitz et al. |
| 2012/0067269 | A1 | 3/2012 | Williams et al. |
| 2012/0137954 | A1 | 6/2012 | Williams et al. |
| 2015/0027360 | A1 | 1/2015 | Schaub |
| 2018/0093118 | A1 | 4/2018 | Laitta et al. |

*Primary Examiner* — Andrew S Lo

(74) *Attorney, Agent, or Firm* — Leber IP Law; Celia H. Leber

(57) ABSTRACT

A foldable diving platform for attachment to a wakeboard tower. The platform includes a base section affixable to tubing of the wakeboard tower and a folding section hinged to the based section. The folding section may be rotated about the hinge to enable storage atop the base section or full deployment collinear and coplanar with the base section.

15 Claims, 6 Drawing Sheets

FOLDABLE DIVING PLATFORM FOR WAKEBOARD TOWER

RELATED APPLICATION

This application is a continuation application of U.S. patent application Ser. No. 15/906,900, filed Feb. 27, 2018, the entire contents of which is hereby incorporated by reference.

FIELD OF THE INVENTION

The present invention relates generally to compact diving platforms and more particularly to a foldable diving platform for attachment to watercraft tower structures.

BACKGROUND OF THE INVENTION

In the field of water sports and recreation with specific regard to boating, there exist many different types of swim platforms. Such platforms are often typically located on the stern of the boat or otherwise attached to the aft-most area of the watercraft.

Fixed swim platforms located at the stern are by far the most common mechanism by which an individual may be enabled to dive from a boat. Typically, such platforms are at or near water level and may extend across the entire width of the stern. Smaller platforms which may extend only for a portion of the stern and which are located at any point along the stern also exist. Such smaller platforms may be either fixed or removable. In either instance of a larger or smaller platform, there may be included a fixed or folding ladder to allow a user the ability to enter and exit the water. Such folding ladder would typically fold downward or otherwise extend in some manner such as a telescoping arrangement into and below the water line. A recreational user of the platform may also use these types of platforms for jumping or diving into the water, though placement is close to the water line and therefore limits any acrobatic movement of the user prior to entering the water.

Raised platforms located atop recreational watercraft have typically been presented in terms of pontoon boats. Due to their inherently stable design, pontoon boats have been known to be outfitted with numerous mechanisms not normally found on smaller recreational watercraft. Such mechanisms have included water slides or gangplank style diving boards. One such diving board which requires a solid, flat mounting surface for installation includes LilliPad brand diving boards manufactured by Lillipad Marine of Traverse City, Mich.

Wakeboard towers are known to exist in the recreational watercraft field. The purpose of such towers is to provide an elevated point at which a tow rope is secured thereby enabling a wakeboard user enhanced vertical movement and acrobatics while being towed behind the watercraft. Such towers typically include customizations that include mechanisms to secure Bimini tops, speakers, and wakeboard storage racks.

None of the known swim platform mechanisms enable use in conjunction with watercraft towers. The present invention overcomes one or more deficiencies of the prior art.

SUMMARY OF THE INVENTION

The present invention provides a foldable diving platform in conjunction with a wakeboard tower of a recreational watercraft. Moreover, the foldable diving platform of the present invention includes both bracing and balancing to provide both secure storage when folded and safe use when deployed.

In accordance with a first aspect, the present invention provides a foldable diving platform for a wakeboard tower, the platform including: a base section including a horizontal surface; a first pair of mounting brackets aligned perpendicular to the horizontal surface; a second pair of mounting brackets aligned at an acute angle towards the first pair of mounting brackets; the first and second pairs of mounting brackets each including apertures at ends thereof for attachment to wakeboard tower tubing; a foldable section including a planar surface; a pair of hinge mechanisms connecting the base section to the foldable section enabling movement of the foldable section between a stored position wherein the horizontal surface is adjacent and parallel to the planar surface and a deployed position wherein the horizontal surface is collinear and coplanar with the planar surface.

The present invention may include an integrated mounting mechanism such as a ladder and may be fabricated from any durable material able be withstand corrosion.

These and other aspects will become apparent from the following drawings and detailed descriptions of exemplary embodiments.

DETAILED DESCRIPTION

The following detailed description provides examples of presently contemplated modes of implementing embodiments of the invention. This description is not to be taken in a limiting sense, but is made merely for the purpose of illustrating general principles of embodiments of the invention. The scope of the invention will be best defined by the claims.

It should be understood that while the present inventive foldable diving platform enables a wakeboard tower affixed to a recreational watercraft to transform into a diving board, neither the tower or watercraft themselves are intended as parts of the present invention. Rather, the platform and mounting brackets are intended to provide the invention as an after-market product to be offered as an attachment to known wakeboard towers.

Figure 1:
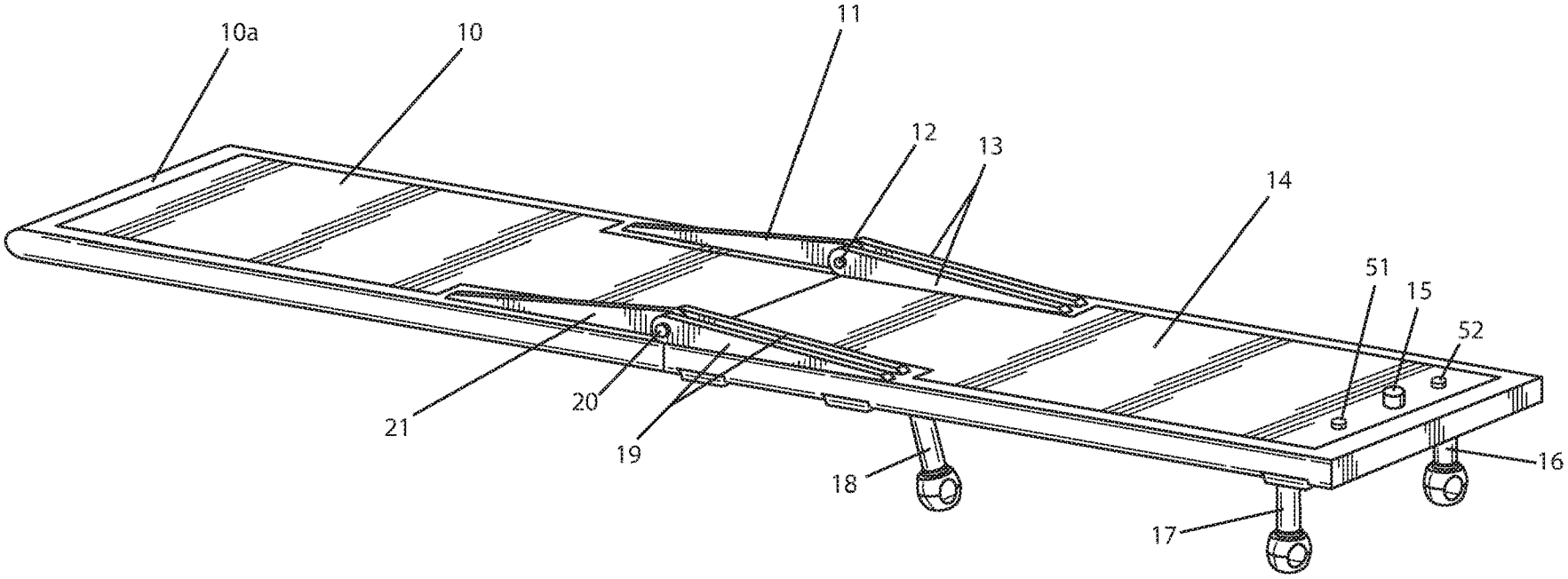
FIG. 1 shows a perspective view of a fully deployed platform in accordance with a preferred embodiment of the present invention.

With reference to FIG. 1, there is provided a foldable diving platform in accordance with a preferred embodiment of the present invention. The platform includes a base section 14 including four mounting brackets (one hidden and three of which are visible as elements 16, 17, and 18). The platform also includes a movable section 10 which is affixed to the base section 14 via two hinge mechanisms. Each hinge mechanism includes brackets 11, 13, 19, 21 and hinge pins 12, 20. As shown, single bracket 11 is a single triangular element while double bracket 13 is a double triangular element that includes an internal slot whereby bracket 11 may rotate into and rest within such slot upon folding the movable section 10 towards and atop the base section 14. The triangular elements are preferably fabricated from a strong material such as steel or aluminum and securely fastened to the base and foldable sections by any suitable manner such as, but not limited to, welding.

Likewise, single bracket 21 is another single triangular element while double bracket 19 is another double triangular element that includes a corresponding internal slot whereby bracket 21 may rotate into and rest within such corresponding internal slot upon folding the movable section 10 towards and atop the base section 14. A spacer 15 is provided so as to allow a resting point upon which the extreme end 10*a* of the movable section 10 may rest. While the invention is shown in a fully open and deployed orientation, it should be understood that the spacer 15 will contact the extreme end 10*a* when the invention is in a fully folded and stored orientation.

Figure 3:
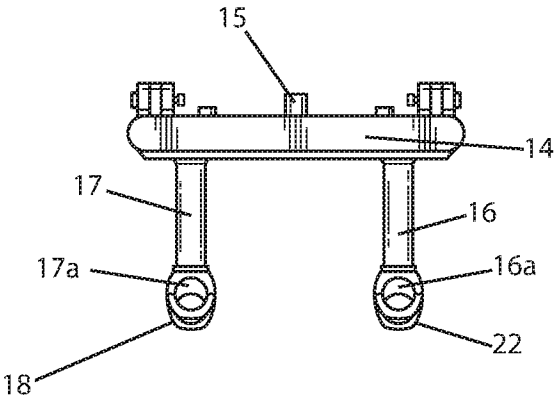
FIGS. 2 and 3 show opposing end views of the platform as shown in FIG. 1 in accordance with the present invention.
Figure 2:
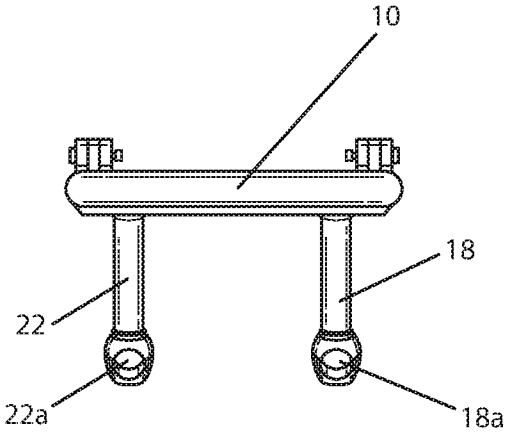

With reference to FIGS. 2 and 3, the present invention as shown in FIG. 1 is seen, respectively, from the foldable section end and the base section end. In FIG. 2, the mounting brackets 18 and 22 are shown and include corresponding apertures 18*a* and 22*a* through which wakeboard tower tubing (not shown) is intended to be retained. Likewise, in FIG. 3, the mounting brackets 16 and 17 are shown and include corresponding apertures 16*a* and 17*a* through which wakeboard tower tubing (not shown) is intended to be retained.

In FIG. 3, mounting brackets 18 and 22 are also visible due to the relative difference in length as compared to mounting brackets 16 and 17. This difference in length is due to the curvature of wakeboard tower tubing and the need to maintain the overall platform surface in a horizontal position relative to the water surface The apertures 16*a*, 17*a*, 18*a*, and 22*a* may be formed by any known mechanical manner including, but not limited to, providing a semi-circular clamshell end piece with screws retaining the end piece to a corresponding semi-circular portion of the given bracket.

Figure 4:
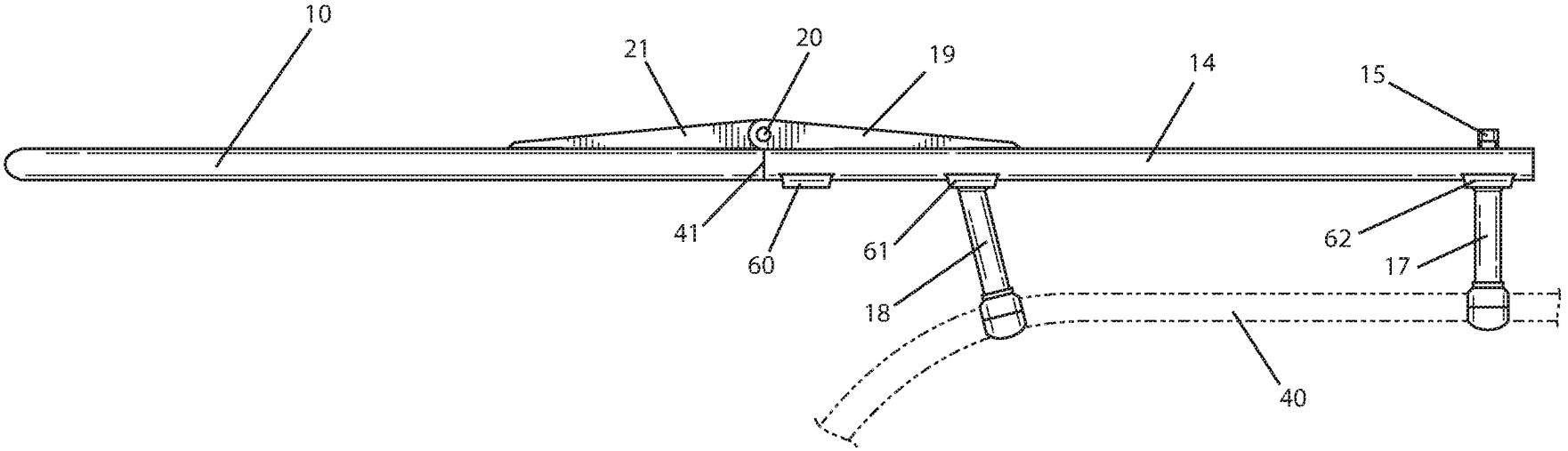
FIG. 4 shows a side view of the platform in accordance with the present invention in place upon a portion of wakeboard tower tubing.

With regard to FIG. 4, a side view of the platform is shown in a fully deployed orientation in accordance with the present invention. Here, tubing 40 of a wakeboard tower is shown in dotted line to illustrate the intended manner of attachment of the invention when in use. As may be seen, mounting bracket 18 is oriented and configured in an angled manner relative to mounting bracket 17 in order to compensate for the curvature of the wakeboard tower tubing 40. When fully extended, the base section 14 and movable section 10 abut one another at the interface 41 which exists adjacent to the hinge pins (only pin 20 being visible from one side).

Figure 5:
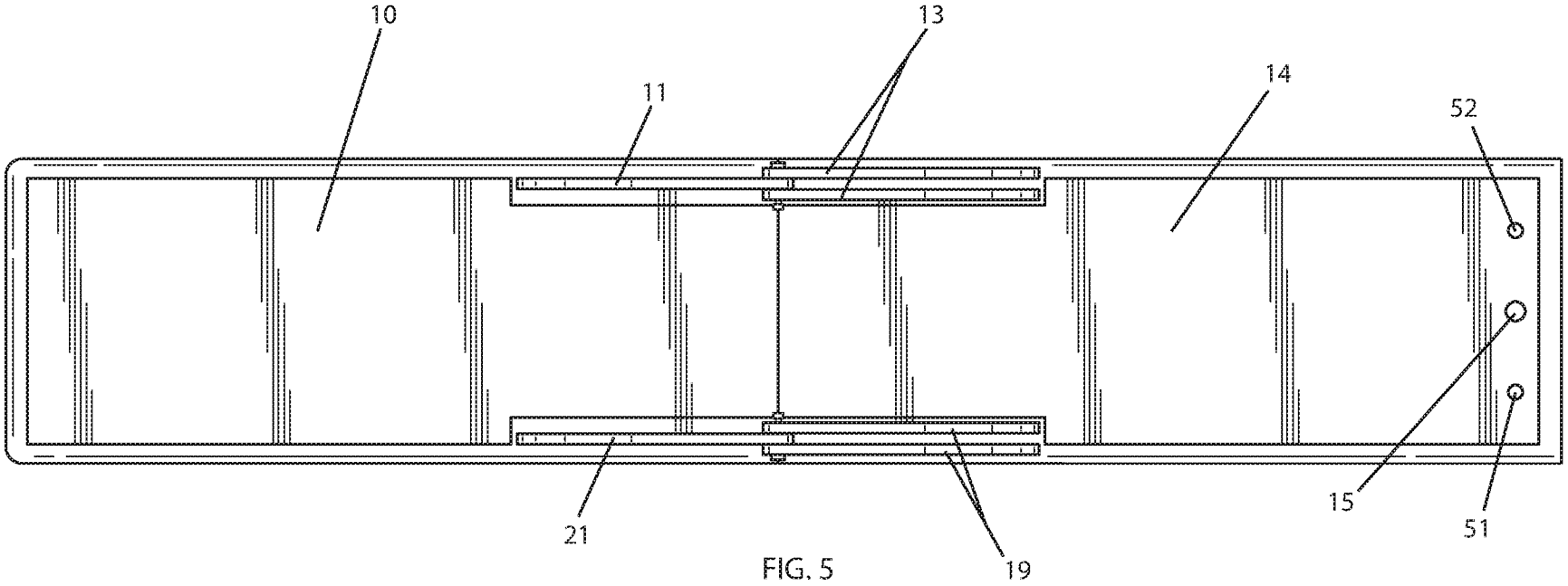
FIG. 5 shows a top view of the platform shown in FIG. 1 in accordance with the present invention.
Figure 6:
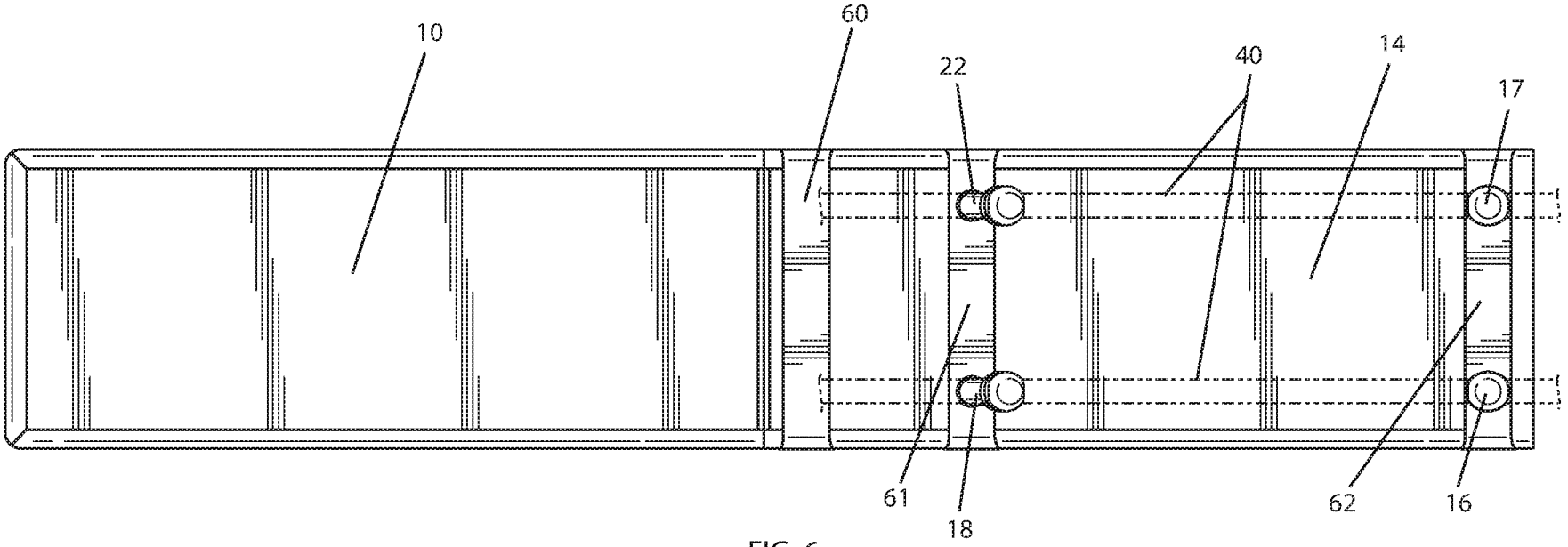
FIG. 6 shows a bottom view of the platform shown in FIG. 1 in accordance with the present invention.

FIGS. 5 and 6 show respectively a top view and a bottom view of the platform in accordance with the present invention. It should be understood that the structural integrity of the platform is enabled by the triangular elements forming the brackets 11, 13, 19, 21 in combination with lateral braces 60, 61, 62 which are underlaid across the bottom surface the width of the base section 14. Lateral braces 60, 61, 62 are most evident when viewed from below the platform as seen in FIG. 6 where bolts 51, 52 are shown retaining lateral brace 62 and brackets 16, 17. Although bolts 51, 52 are visible above the surface of the platform, it should be understood that any manner of secure fastener may be used such as, but not limited to, rivets or welding and may be flush, raised, or recessed relative to the platform surface without straying from the intended scope of the invention.

Figure 7:
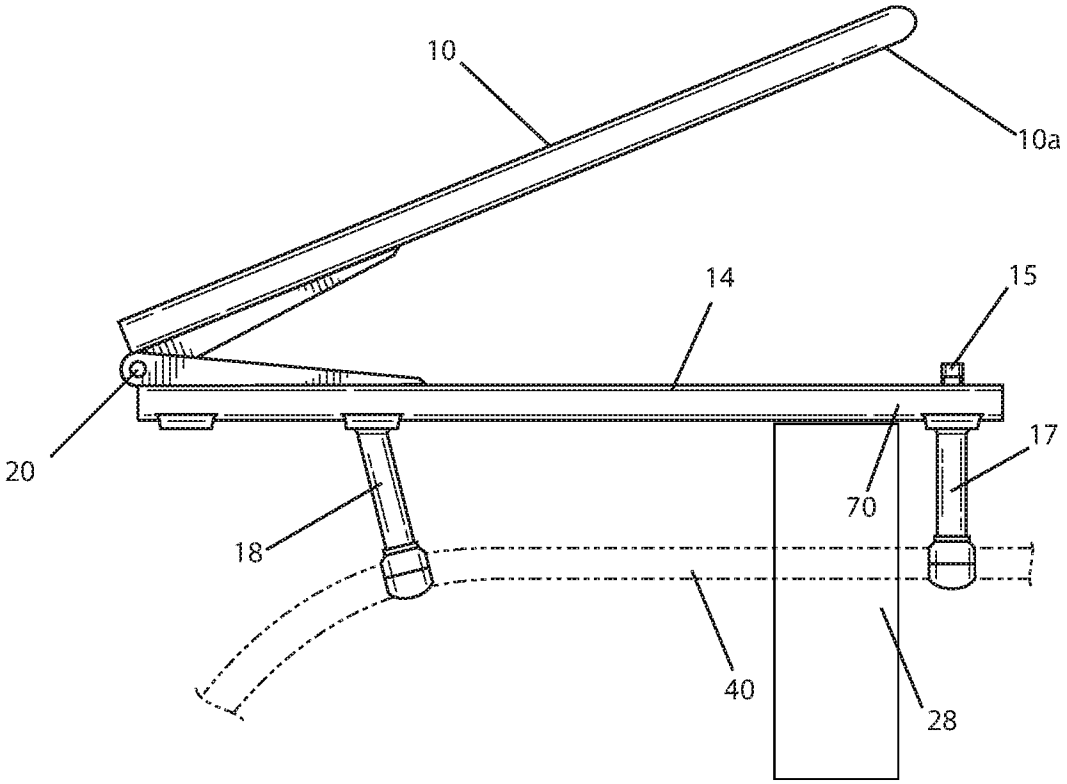
FIG. 7 shows a side view of the platform in accordance with the present invention and in a semi-folded position.

With regard to FIG. 7, the folding action of the present invention is illustrated from a side view of the platform in a semi-folded state between fully deployed and fully folded positions. Here, the base section 14 is seen in place attached to the wakeboard tower tubing 40 via mounting brackets (only brackets 17 and 18 visible from the side). The foldable section 10 of the platform rotates about the hinge pins (only pin 20 visible from the side). It should be understood that once the foldable section 10 is completely in place and folded upon the base section 14, the extreme end 10*a* of the foldable section rests upon or otherwise abuts against the spacer 15 as previously described above.

It should be understood that various other mechanisms may be useful in conjunction with the present invention including, but not limited to, one or more retaining mechanisms for ensuring that the foldable section is securely held in place in either the fully deployed, open position or the fully folded, storage position. Such retaining mechanisms may be in the form of straps, cords, clasps, or any fastener whether plastic or metal or other suitable material.

The present invention may further include a mounting mechanism to enable the user a means by which they may climb or otherwise access the platform once presented in a fully deployed position. Such mounting mechanism may include a fixed or movable ladder of any desired configuration. The size of the ladder may be customized depending upon the height of the given wakeboard tower above the deck surface of the watercraft. Any such ladder may be attached to the base section. For example, the base section may be fabricated with slots along an edge (for example in a rear most area 70 as seen in FIG. 7) such that a ladder having corresponding hooks may be easily affixed to the platform and rest between the base section and the watercraft deck surface. The ladder may be formed of any suitably durable material including, but not limited to, steel, aluminum, or composite polymers. Likewise, the platform may be formed of any similarly durable material suitable for the particular stresses and strains expected in use. It should be understood that any preferred material would be highly durable and corrosion resistant.

In operation, the present invention provides recreational enjoyment of a watercraft having a wakeboard tower through the additional inventive platform. The platform thereby provides a securely mounted elevated diving or jumping surface in a safe and fun manner.

The foregoing description of certain embodiments of the invention has been presented for the purposes of illustration and description. It is not intended to be exhaustive or to limit the invention to the precise form disclosed. Many modifications and variations are possible in light of the above teachings. Therefore, it is intended that the scope of the invention be limited not by this detailed description, but rather by the claims appended hereto.

What is claimed is:

1. A diving platform for a wakeboard tower, said platform comprising:

a platform section including an elongated horizontal surface;

a first pair of mounting brackets extending from and aligned perpendicular to said horizontal surface; and a second pair of mounting brackets extending from the horizontal surface and spaced longitudinally from and aligned at an acute angle towards said first pair of mounting brackets;

said first and second pairs of mounting brackets each including distal ends configured for attachment to wakeboard tower tubing.

2. The platform as claimed in claim 1 wherein the platform is foldable and the platform section includes a base section and a foldable section, mounted on the base section and including a planar surface.

3. The platform as claimed in claim 2 wherein the foldable section is hingedly mounted on the base section.

4. The platform as claimed in claim 3 further comprising a pair of hinge mechanisms connecting said base section to said foldable section, enabling movement of said foldable section between a stored position wherein said horizontal surface is adjacent and parallel to said planar surface and a deployed position wherein said horizontal surface is collinear and coplanar with said planar surface.

5. The platform as claimed in claim 4 wherein said pair of hinge mechanisms each includes a first bracket located on said foldable section and a second bracket located on said base section with a hinge pin provided to enable movement of said first bracket relative to said second bracket.

6. The platform as claimed in claim 5 wherein said first bracket is formed from a single triangular element and said second bracket is formed from a double triangular element, and said second bracket forms a slot into which said first bracket is movable.

7. The platform as claimed in claim 2, further comprising first and second lateral braces extending across the width of the horizontal surface at the attachment points of the first and second pairs of mounting brackets, respectively, providing support to the first and second pairs of mounting brackets and enhancing the structural integrity of the base section.

8. The platform as claimed in claim 7 wherein the platform is foldable and the platform section includes a base section and a foldable section, mounted on the base section and including a planar surface, and further comprises a third lateral brace positioned near an interface between said base section and said foldable section.

9. The platform as claimed in claim 2 wherein said base section includes a spacer on a top surface thereof, said spacer providing a resting surface for said foldable section when said foldable section is in a stored position.

10. The platform as claimed in claim 4 wherein said base section includes a mounting mechanism for enabling a platform user increased access to said platform when said foldable section is in said deployed position.

11. The platform as claimed in claim 10 wherein said mounting mechanism is a ladder.

12. A method of providing a wakeboard tower with a diving platform, the method comprising:

providing a diving platform comprising a platform section including an elongated horizontal surface; a first pair of mounting brackets extending from and aligned perpendicular to said horizontal surface; and a second pair of mounting brackets extending from the horizontal surface and spaced longitudinally from and aligned at an acute angle towards said first pair of mounting brackets; and attaching distal ends of said first and second pairs of mounting brackets to wakeboard tower tubing.

13. The method as claimed in claim 12 wherein the platform is foldable and the platform section includes a base section and a foldable section, mounted on the base section and including a planar surface, and the method includes folding the platform.

14. The method as claimed in claim 13 wherein the foldable section is hingedly mounted on the base section.

15. The method as claimed in claim 14 wherein the platform further comprises a pair of hinge mechanisms connecting said base section to said foldable section, and the method includes moving the foldable section between a stored position wherein said horizontal surface is adjacent and parallel to said planar surface and a deployed position wherein said horizontal surface is collinear and coplanar with said planar surface.

* * * * *